US005988539A

United States Patent [19]

Morey

[11] Patent Number: 5,988,539

[45] Date of Patent: Nov. 23, 1999

[54] WOOD CHIPPER WITH INFEED CHUTE SAFETY DEVICE

[75] Inventor: Michael Boyd Morey, Shepherd, Mich.

[73] Assignee: Tramor, Inc., Remus, Mich.

[21] Appl. No.: 08/957,515

[22] Filed: Oct. 24, 1997

Related U.S. Application Data

[60] Provisional application No. 60/029,014, Oct. 24, 1996.

[51] Int. Cl.[6] ..... B02C 25/00

[52] U.S. Cl. ..... 241/34; 241/36; 241/37.5; 241/92

[58] Field of Search ..... 241/37.5, 36, 92, 241/101.76, 34

[56] References Cited

U.S. PATENT DOCUMENTS

| | | | |
|---|---|---|---|
| Re. 33,840 | 3/1992 | Peterson et al. . | |
| 3,069,101 | 12/1962 | Wexell . | |
| 3,076,489 | 2/1963 | Schmidt et al. . | |
| 3,182,917 | 5/1965 | Tamny et al. . | |
| 3,276,700 | 10/1966 | Eklund . | |
| 3,463,405 | 8/1969 | Shepherd . | |
| 3,559,724 | 2/1971 | Wilkinson . | |
| 3,635,410 | 1/1972 | Smith . | |
| 3,868,062 | 2/1975 | Cunningham et al. . | |
| 3,939,886 | 2/1976 | Tucek . | |
| 3,989,198 | 11/1976 | Blasko . | |
| 4,022,021 | 5/1977 | Russell, Jr. . | |
| 4,260,114 | 4/1981 | Herder | 241/37.5 |
| 4,452,400 | 6/1984 | Williams . | |
| 4,560,110 | 12/1985 | Burda . | |
| 4,685,624 | 8/1987 | Nidiffer et al. . | |
| 4,687,179 | 8/1987 | Smith . | |
| 4,692,028 | 9/1987 | Schave . | |
| 4,716,823 | 1/1988 | Capdevila . | |
| 4,721,257 | 1/1988 | Williams et al. . | |
| 4,793,561 | 12/1988 | Burda . | |
| 4,906,486 | 3/1990 | Young . | |
| 5,005,620 | 4/1991 | Morey . | |
| 5,018,672 | 5/1991 | Peck et al. | 241/37.5 |
| 5,088,532 | 2/1992 | Eggers et al. . | |
| 5,167,374 | 12/1992 | Strohmeyer | 241/36 |
| 5,263,651 | 11/1993 | Nadarajah . | |
| 5,358,189 | 10/1994 | Vandermolen . | |
| 5,667,152 | 9/1997 | Mooring | 241/37.5 |

FOREIGN PATENT DOCUMENTS

| | | | |
|---|---|---|---|
| 3624996 | 2/1988 | Germany | 241/36 |
| 3808487 | 5/1989 | Germany | 241/36 |

*Primary Examiner*—Mark Rosenbaum
*Attorney, Agent, or Firm*—Bliss McGlynn, P.C.

[57] ABSTRACT

A waste reducing machine, such as a wood chipper, is constructed having a powered cutting system, a powered feed system, and an infeed chute. The waste reducing machine includes the combination of an actuator mounted to the machine extending partially into the infeed chute and a safety device in communication with the actuator to stop or reverse the motive power directed to the cutting system, feed wheels, or both.

12 Claims, 5 Drawing Sheets

FIG 4
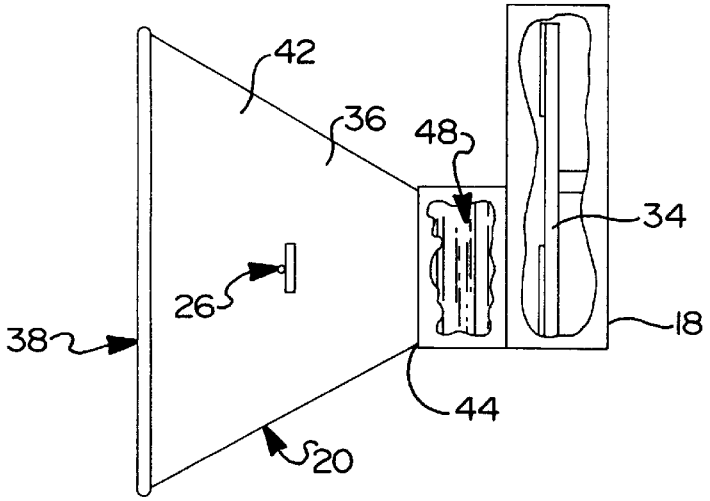
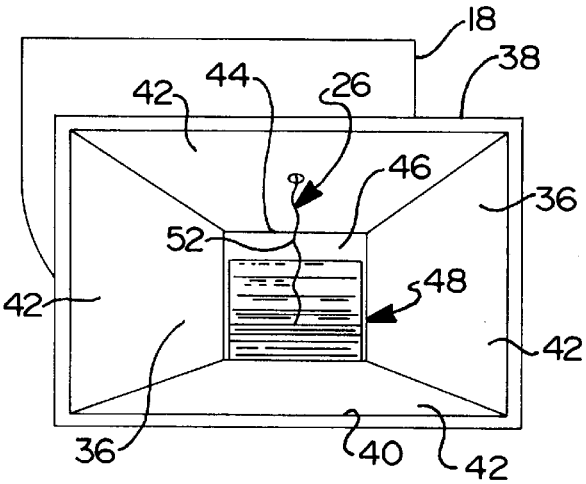
FIG 3
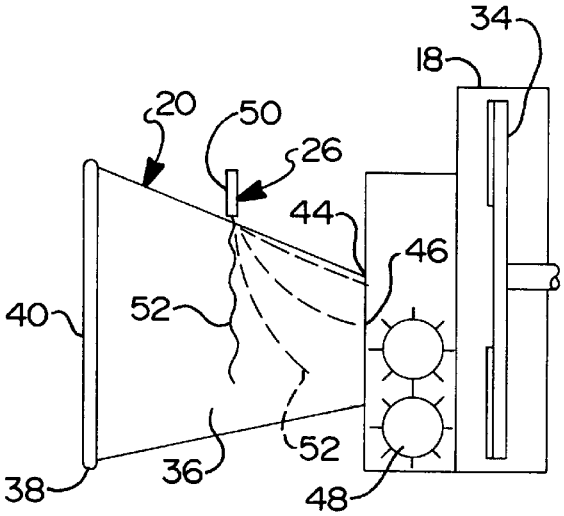
FIG 2

FIG 5
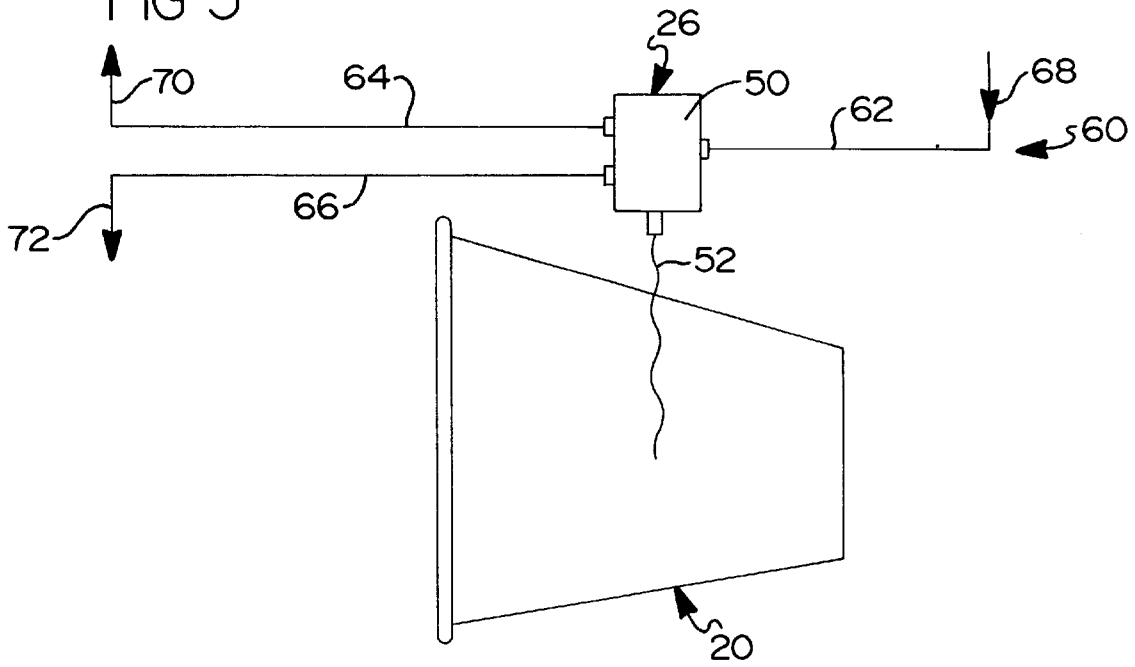
FIG 6
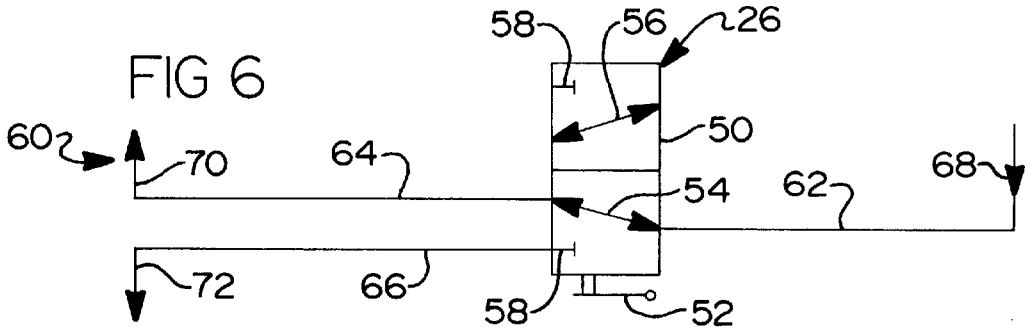
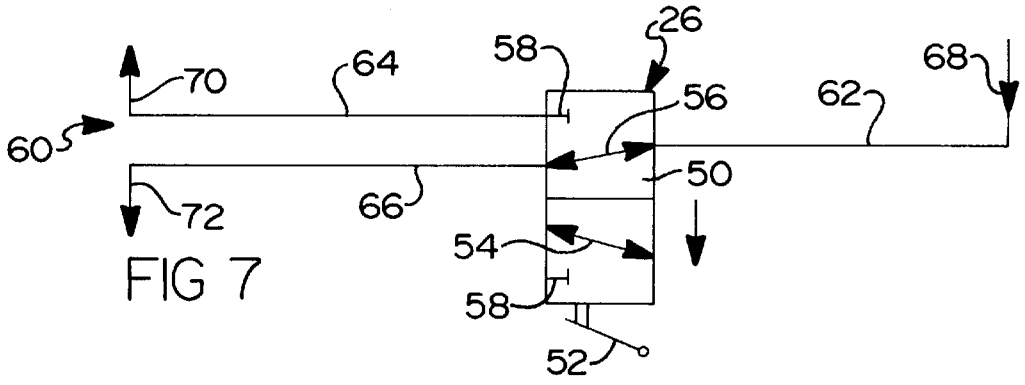
FIG 7

WOOD CHIPPER WITH INFEED CHUTE SAFETY DEVICE

This application claims benefit of PROVISIONAL APPLICATION SERIAL No. 60/029,014 filed Oct. 24, 1996.

BACKGROUND OF THE INVENTION

1. Field of the Invention

This invention relates to wood chippers and, more particularly, to wood chippers having one or more feed wheels for controlling the infeed of bulk wood products, one or more cutting blades which create and direct the produced wood chips toward a discharge chute, and an emergency safety device actuator located in the infeed chute to stop or reverse the motive power directed to the feed wheels, the cutting blade, or both.

2. Description of Related Art

Wood chippers are used to reduce branches, trees, and other bulk wood products into small wood chips. A typical wood chipper often contains an infeed chute, a feed system for controlling the feed rate of wood products, a wood chipping mechanism, a drive system for the feed system and chipping mechanism, and a discharge chute. The infeed chute is typically a funnel-type conduit provided with a wide opening which tapers toward the feed system to converge the bulk wood products toward the chipping mechanism. Through the action of the feed system, the bulk wood products are brought into contact with the chipping mechanism which grinds, flails, or cuts the wood products into small pieces and propels the small pieces into the discharge chute where they exit the wood chipper.

These types of wood chippers are, if operated incorrectly, dangerous devices. The chipping mechanism typically rotates at a high speed and produces high torques which are necessary to chip the wood. The feed system located at the narrowest point of the infeed chute is a dangerous area which can catch a user's clothing or, more importantly, a user's limb if he improperly reaches into the infeed chute during operation of the chipper. If a user does get entangled in the feed system of known chippers, the user may not be able to reach a shutoff actuator located outside of the chute.

SUMMARY OF INVENTION

A wood chipper according to the invention incorporates a safety device to cut off power to a feed system, a cutting mechanism, or both in a wood chipper. Alternatively, a safety device to reverse the feed system, cutting mechanism, or both can be incorporated. The invention is an improvement for any waste reducing machinery which receives waste products through an infeed chute. According to the invention, an actuator for a emergency safety device extends into the infeed chute so that it can be easily reached and actuated by a user inside the infeed chute. In one aspect of the invention, the rotary feed wheels are powered by a hydraulic system, and the emergency safety device actuates a diverter valve which deflects a supply of hydraulic fluid in the drive system away from the feed wheels toward a supply tank. In another aspect of the invention, the emergency safety device reverses the flow of hydraulic fluid to reverse the direction of rotation of the feed system. The actuator and emergency safety switch according to the invention can be incorporated into any waste reducing machinery regardless of the drive system and can be used to cut off power to the feed system, cutting blades, or both. With the actuator and cut-off device according to the invention, the user is provided with additional means to immediately cut off power to the feed system, cutting mechanism, or both in the wood chipper if an emergency situation arises.

BRIEF DESCRIPTION OF THE DRAWINGS

The will now be described with reference to the drawings wherein:

FIG. 2 is a side, cross-sectional view of an infeed chute on the wood chipper of FIG. 1 which is provided with an emergency safety device according to the invention;

FIG. 3 is a front elevational view of the infeed chute of FIG. 2;

FIG. 4 is a top plan view of an infeed chute of FIG. 2 with sections broken away to show the feed wheels and the cutting mechanism;

FIG. 5 is a side-elevational view of the infeed chute of FIG. 2 provided with an emergency safety device according to the invention with the remaining elements of the wood chipper removed for clarity and a portion of a power circuit of the wood chipper shown diagrammatically;

FIG. 6 is a diagrammatical view of the emergency safety device of FIG. 5 in an operational position wherein power is delivered to a feed system in the wood chipper;

FIG. 7 is a diagrammatical view of the emergency safety device of FIG. 5 in an open position wherein power is diverted away from the feed system;

DESCRIPTION OF THE PREFERRED EMBODIMENT

Figure 1:
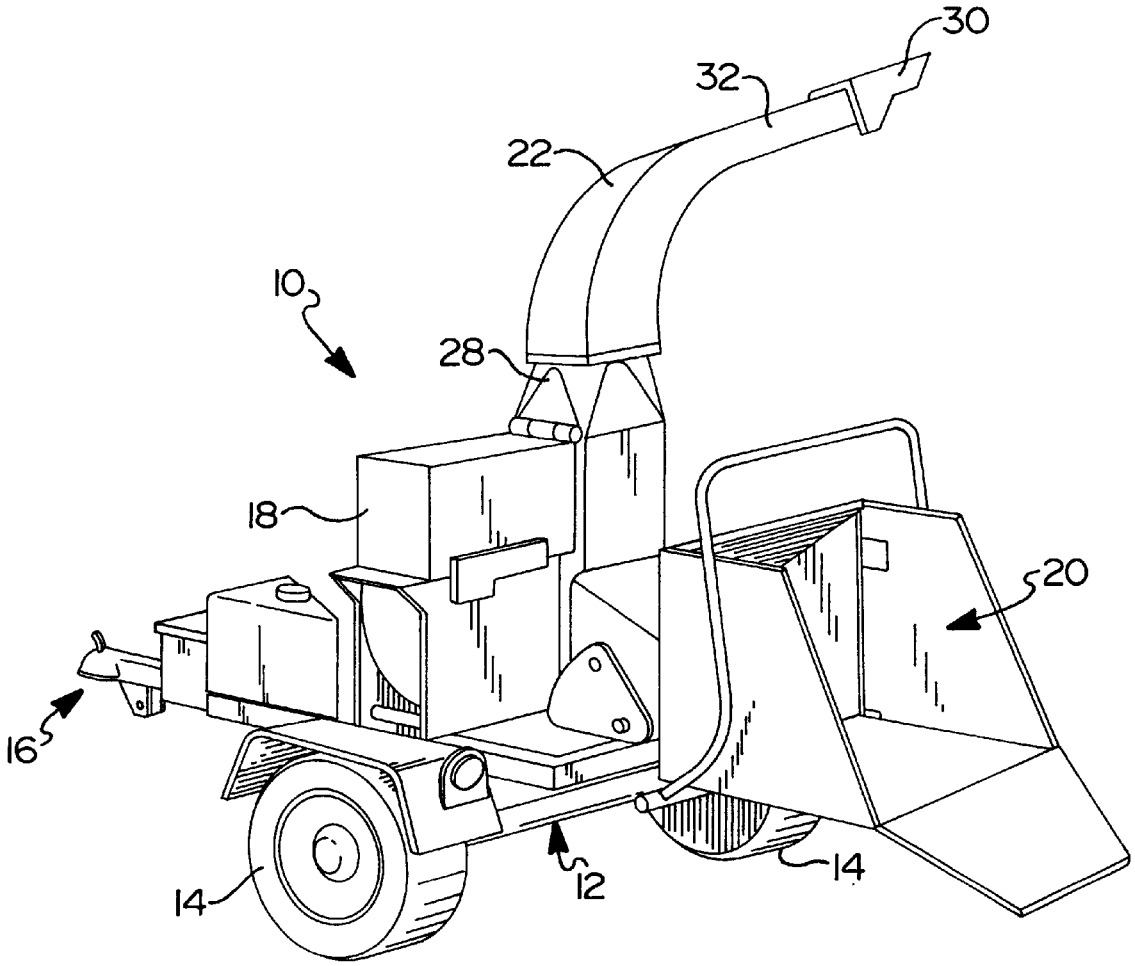
FIG. 1 is a perspective view of a wood chipper assembly.

Referring now to the drawings and to FIG. 1 in particular, a wood chipper shown generally at 10 includes a frame 12 supported by a pair of wheels 14 and a conventional trailer hitch 16 to allow the chipper to be towed by a vehicle. Supported on the chipper frame 12 are a chipper hood 18, an infeed chute 20, and a discharge chute 22. An internal combustion engine 24 (not shown) is also mounted on the frame 12 to provide rotational energy to both a feed wheel system 48 (FIG. 2) and a cutting blade 34 (FIG. 2). The chipper hood 18 encloses the rotary cutting mechanism or blade 34 to prevent high-velocity pieces of wood from exiting the wood chipping mechanism before being dispensed through the discharge chute 22. A swivel bracket 28 is mounted between the chipper assembly 18 and the discharge chute 22 in order to allow the discharge chute 22 to be rotatably aligned to expel wood chips in a desired direction. In addition, the discharge chute 22 also includes an adjustable deflector 30 mounted at the discharge chute exit 32 to allow further control over the direction of the exiting wood chip stream.

The internal combustion engine should be operated such that the rotary cutting blade 18 is rotating at a high velocity but the feed wheels 48 rotate relatively slowly. In operation, trees, brush, and other bulk wood products are fed into the infeed chute 20 and captured between the opposed, rotating feed wheels 48 until the wood products encounter the rotary cutting blade 34. The cutting blade 34 reduces the bulk wood products into chips which are expelled from the mechanism in a high-velocity air stream so that centrifugal force is imparted to the wood chips and they are driven into the discharge chute 22. The wood chips enter the discharge chute 22 with sufficient linear velocity to be flung an adequate distance from the wood chipper 10. If desired, the swivel bracket 28 at the base of the discharge chute 22 and the deflector 30 at the exit point 32 of the discharge chute 22 may be adjusted to direct the exiting wood chip stream to a particular location away from the wood chipper 10.

Referring now to FIGS. 1–4, a wood chipper 10 incorporating an infeed chute shutoff according to the invention is shown. In the event that a portion of the user's body or clothing becomes captured by the feed wheels 48 and drawn toward or into the cutting mechanism, an interior portion of the infeed chute 20 includes an actuator 52 of an emergency safety device 26 which may be actuated to quickly shut off the power supply to feed wheels 48, the cutting blade 34, or both.

FIGS. 2–4 show an infeed chute 20 provided with the actuator 52 of the emergency safety device 26 accessible at an interior portion thereof according to the invention. The infeed chute 20 is a funnel-type conduit 36 which has an outer end 38 defining a wide opening 40 which tapers along sidewalls 42 toward an inner end 44 defining a smaller exit 46. The opposed rotary feed wheels, shown generally at 48, is located immediately adjacent the exit 46 of the infeed chute 20 so that infed bulk wood products are converged toward the feed wheels 48. The rotary cutting blade 34 is mounted immediately adjacent the feed wheels so that the feed wheels drive the bulk wood products into contact with the cutting elements of the blade 34.

It will be understood that the wood chipper 10 can comprise any suitable waste reducing machinery such as the trailerable wood chipper as seen in FIG. 1 or any other movable or stationary machinery used to chip, grind, cut, or otherwise reduce bulk products. While the preferred embodiment incorporates a pair of opposed, horizontally aligned feed wheels, it is understood that any feed system can be incorporated into the invention. It will be further understood that this application describes the structure and operation of the emergency safety switch 26 with respect to hydraulic systems, but that the wood chipper 10 can be powered by any other suitable methods including, but not limited to, electricity, gas, diesel, or a power take-off from an auxiliary power source without departing from the scope of this invention. One example of a suitable wood chipper 10 on which the invention can be incorporated is seen in U.S. Pat. No. 5,088,532 which is expressly incorporated herein by reference.

As shown generally in FIG. 5, the emergency safety device 26 generally comprises a body 50 and an actuator 52. The body 50 of the safety device 26 is operationally connected to a power circuit 60 so that actuation of the safety device 26 diverts the flow of power through the device 26, thereby cutting off the flow of power to the feed wheel system 48, cutting mechanism 34, or both. The actuator 52 can comprise any suitable mechanism to actuate the safety device 26 such as a button, toggle switch, or handle. As shown in FIG. 2, the preferred embodiment of the actuator 52 comprises a cable or cord mounted to the body 50 which can be actuated merely by pulling downwardly thereon. The end of the cable can be weighted so as to prevent the cable from being drawn toward the cutting mechanism 48 at the end of the infeed chute 20, shown by the phantom lines in FIG. 2. Preferably, the cable should be as long as possible without interfering with the operating of the cutting mechanism.

The portion of the power circuit 60 shown in FIG. 5 comprises a power inflow line 62 which passes through the body 50 and first and second outflow lines 64 and 66 which extend out of the body 50. The inflow line 62 is operatively connected to a power source shown diagrammatically at 68 by an arrow. In the preferred embodiment, the first outflow line 64 is operatively connected to the feed wheel system 48, shown diagrammatically at 70 by an arrow at the end of the first outflow line 64, so that power flowing through the first outflow line 64 powers the feed wheels. The second outflow line 66 is operatively connected to a power return or open circuit, shown diagrammatically at 72 by an arrow at the end of the second outflow line 66, so that power flowing through the second outflow line 66 is merely returned to a fluid reservoir and no power flows to the feed system.

The safety device 26 is selectively movable between a powered position and an open position shown in FIGS. 6 and 7, respectively. As illustrated in FIG. 6, the body 50 of the safety device 26 is normally biased into the powered position. The body 50 of the safety device 26 includes first and second internal conduits 54 and 56, respectively, and a pair of conduit terminators 58.

The first internal conduit 54 is located in one portion of the body 50 adjacent the inflow line 62 and extends toward an opposite side of the body 50 adjacent the outflow lines 64 and 66. A conduit terminator 58 is located adjacent the first internal conduit 54 so that the first internal conduit 54 and the conduit terminator 58 can align with the first and second outflow lines 64 and 66, respectively, in the powered position as shown in FIG. 6.

The second internal conduit 56 is located in another portion of the body 50 adjacent the inflow line 62 and extends toward an opposite side of the body 50 adjacent the outflow lines 64 and 66. A conduit terminator 58 is located adjacent the second internal conduit 56 so that the conduit terminator 58 and the second internal conduit 56 can align with the first and second outflow lines 64 and 66, respectively, in the open position as shown in FIG. 7.

When either of the first and second outflow lines 64 and 66 are aligned with a conduit terminator 58, it will be understood that no power flows through that respective outflow line. Alternately, when either of the first or second outflow lines 64 and 66 are aligned with one of the first and second internal conduits 54 and 56, it will be understood that power is transferred from the inflow line 62, through the internal conduit 54, 56, and out through the aligned outflow line 64, 66.

Figure 8:
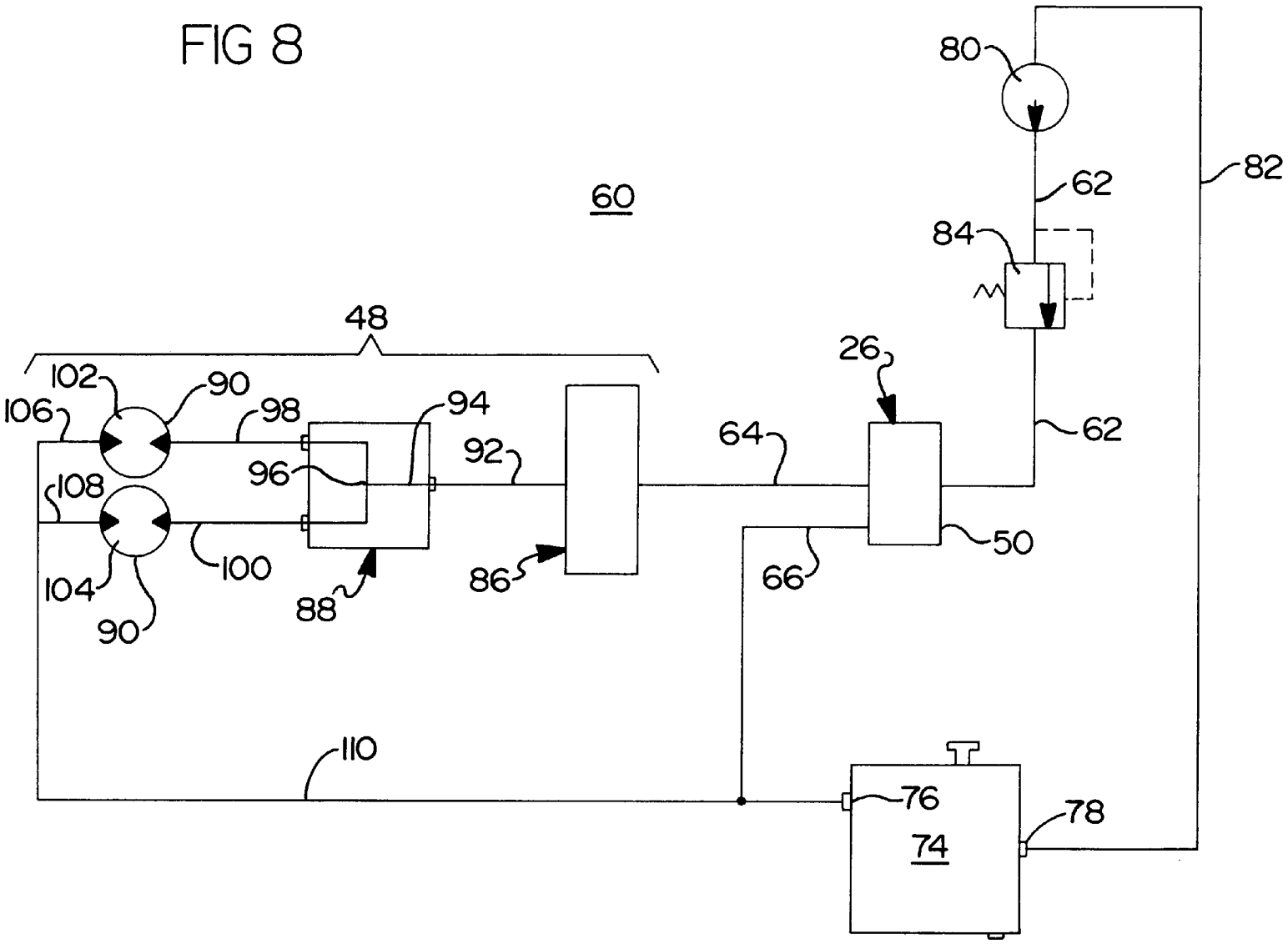
FIG. 8 is a diagrammatical view of a power circuit for a wood chipper provided with an emergency safety device according to the invention.

FIG. 8 shows a typical complete hydraulic power circuit 60 for a wood chipper 10. It will be understood that equivalent components can be used, such as an electrically-powered, gas-powered, or auxiliary-powered wood chipper, without departing from the scope of this invention. A storage tank 74 for hydraulic fluid is shown having an inlet port 76 and an outlet port 78 thereon. The outlet port 78 of the tank 74 is connected to a pump 80 by a feed line 82. An outlet port of the pump 80 is connected to the inflow line 62 as shown. A pressure relief mechanism 84 can be disposed along the inflow line 62 as needed.

As described above, the inflow line 62 extends into the body 50 of the safety device 26 which, in turn, extends outwardly into the first and second outflow lines 64 and 66, respectively. Movement of the actuator 52 selectively positions the body 50 so that the inflow line 62 is alternately connected to the first and second outflow lines 64 and 66. The other of the first and second outflow lines 64 and 66 not connected to the inflow line 62 is aligned with a conduit terminator 58 so that no power flows through that particular outflow line.

In the preferred embodiment, the first outflow line 64 is connected to a conventional feed wheel system 48 which comprises at least a control valve 86, a flow divider 88, and feed wheel motors 90. The control valve 86 receives the first outflow line 64 and controls the flow of fluid therethrough at a rate selected by the user. The control valve 86 includes an outflow line 92 which extends between the control valve 86 and the flow divider 88. The flow divider 88 includes an inlet conduit 94 which is operationally connected to the outflow line 92 of the control valve 86. An opposite end of the inlet conduit 94 of the flow divider 88 splits at 96 into first and second outflow conduits 98 and 100. The first and second outflow conduits 98 and 100 power individual feed wheels 102 and 104 of the feed wheel motors 90. First and second conduits 106 and 108 carry fluid beyond the feed wheels 102 and 104 and fluidly connect with a return conduit 110 which extends into the inlet port 76 of the tank 74, thus completing the circuit.

The second outflow line 66 "short circuits" the feed wheel system 48 and extends directly into the return conduit 110 and thus, immediately into the tank 74. In general, the body 50 of the switch 26 is biased into the powered position as shown in FIG. 6. Therefore, an operator can move the actuator 52 of the switch 26 to align the body 50 in the open position so that the first outflow line 64 is aligned with a conduit terminator 58 and the second outflow line 66 is aligned with the second internal conduit 56. Thus, any fluid flowing into the body 50 from the inflow line 62 is returned immediately to the tank 74 through the interconnection of the second outflow line 66 with the return conduit 110. As noted above, the emergency safety device in the preferred embodiment is provided between the power source and the feed wheel system 48. As noted above, the emergency safety device 26 can also be positioned between the power source and the cutting blade 34 or between the power source and both of the cutting blade 34 and feed wheel system 48. When the emergency safety device 26 is adapted to control the rotation of the cutting blade 34, the hydraulic schematic of this system is substantially identical to that seen in FIG. 8, except that the cutting blade is substituted for the flow divider 88 and feed mechanism 90.

Figure 9:
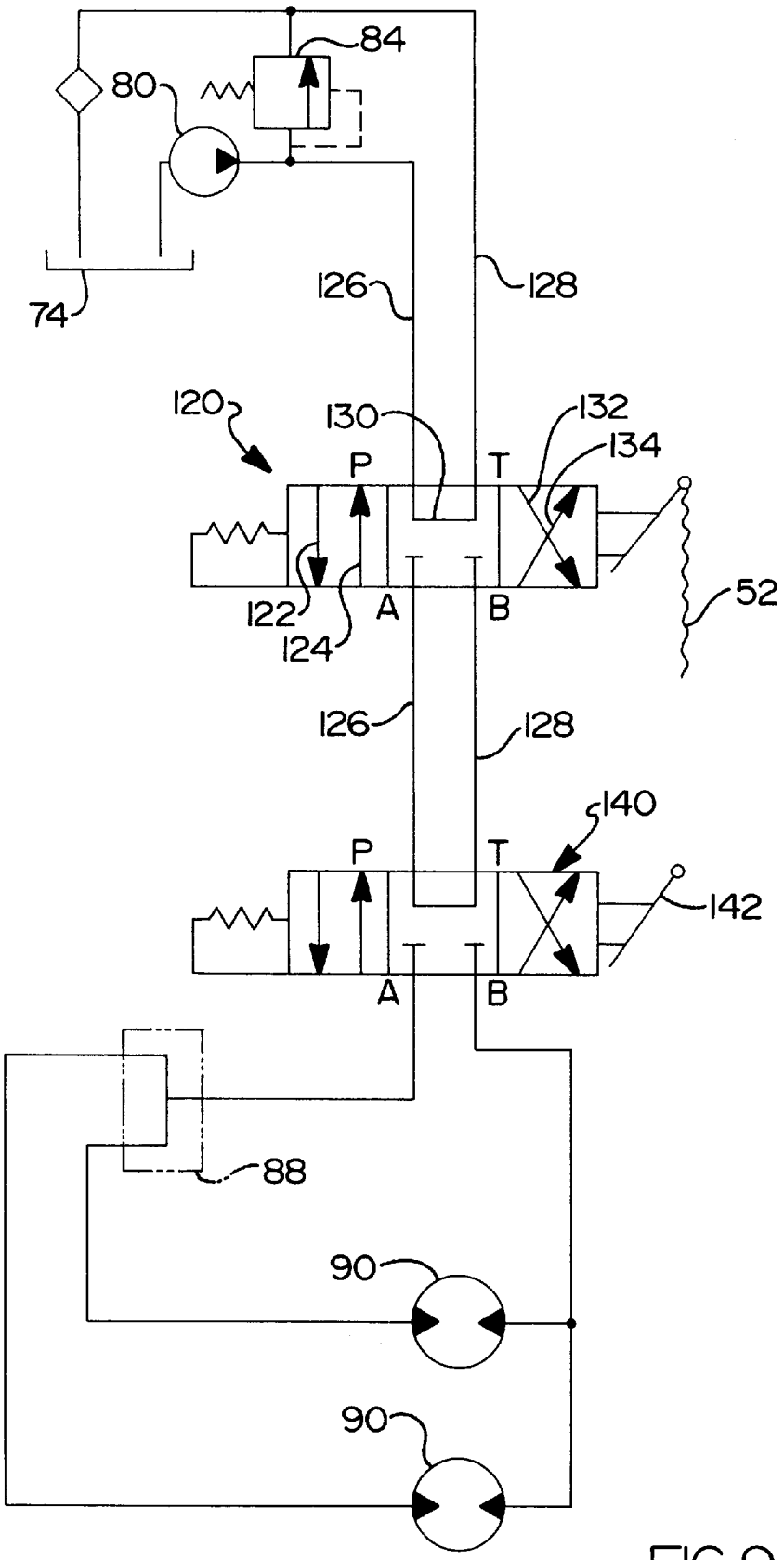
FIG. 9 is a diagrammatical view of an alternative embodiment of a power circuit according to the invention.

FIG. 9 is a diagrammatical representation of an alternative embodiment of the power system for a wood chipper according to the invention. In this embodiment, the emergency safety device 120 is provided with three different positions, depending upon the position of the actuator 52. As in the earlier embodiment, the emergency safety device 120 is positioned between the hydraulic pump 80 and the feed wheel motors 90. In a first position of the emergency safety device 120, fluid flow conduits 122, 124 are adapted to complete the fluid flow circuit of the fluid supply line 126 and return line 128. This is the normal operating position such that pressurized fluid from the pump will flow through the supply line, through the conduit 122 to the motors 90, and return to the tank 74 through the return line 128 and the flow conduit 124.

In the event that a situation arises which requires the immediate stopping of the rotation of the feed wheels, the user pulls on the actuator 50 and moves the emergency safety switch 120 to the second position, as seen in FIG. 9. In this position, the pressurized fluid supplied by the pump 80 through the supply line 126 is immediately dumped back to the tank 74 by a short circuiting conduit 130 provided inside the emergency safety device. In this position, no pressurized fluid is supplied to the feed wheel motors 90.

The emergency safety device 120 of this embodiment differs from the earlier embodiments in that the actuator 50 can be pulled further to position the emergency safety device 120 in a third position which reverses the rotation of the feed wheels. As seen schematically in FIG. 9, in the third position, a pair of flow conduits 132, 134 serve to redirect the pressurized fluid supplied by the pump. Flow conduit 132 fluidly interconnects the fluid supply line 126 positioned upstream from the switch 120 with the return line 128 positioned downstream from the safety device 120. Similarly, flow conduit 134 serves to fluidly interconnect the supply line 126 positioned downstream from the safety device 120 with the return line positioned downstream from the safety device 120. This will reverse the direction of pressurized fluid which acts on the feed wheel motors 90, thereby reversing the rotational direction of the feed wheel motors. Therefore, if an emergency situation arises, the user can pull the actuator to a first position to stop the feed wheels or pull the actuator to a second position to reverse the direction of rotation of the feed wheels.

A similar three-position valve 140 is preferably positioned downstream from the emergency safety device 120. This three-position switch is connected to an actuator or control bar 142 which operates as the primary means for actuating the control of the directional rotation of the feed wheels. Similar to the emergency safety device 120 described above, the three-position switch 140 has conduits provided therein so that in the first position, the feed wheels will rotate in the normal operating direction, in a second position, all of the pressurized fluid is rediverted back to the reservoir, i.e., the stop position, and in the third position, the direction of supply of pressurized fluid to the feed wheel motors 90 is reversed, thereby reversing the direction of rotation of the feed wheels.

The invention allows an operator to operate the wood chipper 10 and be able to quickly deactivate the cutting mechanism and/or feed mechanism thereof. The actuator 52 of the feed mechanism is conveniently located within the infeed chute 20 of the chipper 10 so that in the unlikely event that the operator's limb or clothing is caught in the cutting and/or feed mechanism, thereby preventing their ability to move away from the chipper or chute 20, then means are provided so that the user can quickly and easily disable the cutting and/or feed mechanisms.

Reasonable variation and modification are possible within the spirit of the foregoing specification and drawings without departing from the scope of the invention.

I claim:

1. A wood chipper having a powered cutting system, a powered feed system, and an infeed chute, wherein the improvement relates to a safety system which comprises:

an actuator having at least two operable positions within the infeed chute mounted to the wood chipper and extending at least partially into the infeed chute; and a safety device switch body in communication with said actuator adapted to control motive operation of at least one of the powered cutting system and powered feed system.

2. A wood chipper according to claim 1 wherein said actuator is adapted to selectively control the operation of said safety device.

3. A wood chipper according to claim 2 wherein said actuator is adapted to move between a first predetermined state, a second predetermined state, and a third predetermined state.

4. A wood chipper according to claim 3 wherein said safety device is adapted to permit motive operation of both said powered cutting system and said powered feed system when said actuator is in said first predetermined state and said safety device is adapted to interrupt motive operation of at least one of said powered feed system and said powered cutting system when said actuator is in said second predetermined state and said safety device is adapted to reverse the direction of motive operation of at least one of said powered feed system and said powered cutting system when said actuator is in said third predetermined state.

5. A wood chipper according to claim 2 wherein said actuator is adapted to move between a first predetermined state and a second predetermined state.

6. A wood chipper according to claim 5 wherein said safety device is adapted to permit motive operation of both said powered cutting system and said powered feed system when said actuator is in said first predetermined state and said safety device is adapted to interrupt motive operation of at least one of said powered feed system and said powered cutting system when said actuator is in said second predetermined state.

7. A wood chipper according to claim 6 wherein said actuator is a switch mounted on the interior of said infeed chute.

8. A wood chipper according to claim 6 wherein said safety device is adapted to actuate a diverter valve adapted to deflect a flow of hydraulic fluid from at least one of said powered feed system and said powered cutting system toward a hydraulic reservoir when said actuator is in said second predetermined state.

9. A wood chipper according to claim 1 wherein said actuator is a cable.

10. A wood chipper according to claim 1 wherein said actuator is an elongated handle.

11. A wood chipper comprising:

an infeed chute having an interior portion;

a discharge chute;

a feed mechanism disposed between said infeed chute and said discharge chute;

a cutting mechanism disposed between said feed mechanism and said discharge chute; and an infeed chute shutoff disposed in said interior portion of said infeed chute to shut off power to at least one of said feed mechanism and said cutting mechanism.

12. A wood chipper comprising:

an infeed chute having an interior portion;

a discharge chute;

a feed mechanism disposed between said infeed chute and said discharge chute;

a cutting mechanism disposed between said feed mechanism and said discharge chute; and an actuator disposed in said interior portion of said infeed chute to shut off power to at least one of said feed mechanism and said cutting mechanism.

* * * * *